US011101556B2

(12) United States Patent
Shimura

(10) Patent No.: US 11,101,556 B2
(45) Date of Patent: Aug. 24, 2021

(54) ANTENNA

(71) Applicant: CANON KABUSHIKI KAISHA, Tokyo (JP)

(72) Inventor: Hajime Shimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 63 days.

(21) Appl. No.: 16/231,348

(22) Filed: Dec. 21, 2018

(65) Prior Publication Data

US 2019/0207301 A1 Jul. 4, 2019

(30) Foreign Application Priority Data

Dec. 28, 2017 (JP) ..... JP2017-253435

(51) Int. Cl.

| | |
|---|---|
| ***H01Q 1/36*** | (2006.01) |
| ***H01Q 1/38*** | (2006.01) |
| ***H01Q 9/42*** | (2006.01) |
| ***H01Q 21/06*** | (2006.01) |
| ***H01Q 1/22*** | (2006.01) |
| ***H01Q 5/378*** | (2015.01) |

(52) U.S. Cl.

CPC ..... *H01Q 1/362* (2013.01); *H01Q 1/38* (2013.01); *H01Q 5/378* (2015.01); *H01Q 9/42* (2013.01); *H01Q 21/061* (2013.01); *H01Q 1/2291* (2013.01)

(58) Field of Classification Search

CPC ..... H01Q 1/362; H01Q 1/38; H01Q 1/2291; H01Q 5/378; H01Q 7/00; H01Q 9/27; H01Q 9/42; H01Q 11/08; H01Q 21/061; H01Q 1/36; H01Q 1/2283; H01Q 1/243; H01Q 5/385; H01Q 5/392; H01Q 9/30; H01Q 9/38; H01Q 11/083

See application file for complete search history.

(56) References Cited

U.S. PATENT DOCUMENTS

| | | | | |
|---|---|---|---|---|
| 6,028,568 | A * | 2/2000 | Asakura | H01Q 1/362 343/700 MS |
| 6,765,536 | B2 * | 7/2004 | Phillips | H01Q 1/362 343/702 |
| 6,897,812 | B2 * | 5/2005 | Huang | H01Q 1/362 343/700 MS |
| 8,175,067 | B2 | 5/2012 | Shimura | |
| 8,547,947 | B2 | 10/2013 | Shimura | |
| 8,699,431 | B2 | 4/2014 | Shimura | |
| 8,804,683 | B2 | 8/2014 | Shimura | |
| 8,976,772 | B2 | 3/2015 | Shimura | |
| 9,287,621 | B2 | 3/2016 | Shimura | |

(Continued)

FOREIGN PATENT DOCUMENTS

JP 9-69718 3/1997

*Primary Examiner* — Robert Karacsony

(74) *Attorney, Agent, or Firm* — Venable LLP

(57) ABSTRACT

An antenna includes: a feeding point; an antenna element unit having one end connected to the feeding point and the other end connected to the ground conductor; and a first conductive portion connected to the ground conductor. The antenna element unit has, between one end and the other end, a second conductor portion having a shape in which a plurality of bent parts are formed, and at least a part of the antenna element unit and at least a part of the first conductive portion are electromagnetically coupled with each other.

15 Claims, 17 Drawing Sheets

(56) References Cited

U.S. PATENT DOCUMENTS

| | | | | |
|---|---|---|---|---|
| 9,570,803 | B2 | 2/2017 | Shimura | |
| 9,899,738 | B2 | 2/2018 | Shimura | |
| 2003/0080904 | A1* | 5/2003 | Chen | H01Q 1/38 343/700 MS |
| 2009/0079639 | A1* | 3/2009 | Hotta | H01Q 1/243 343/702 |
| 2016/0372976 | A1 | 12/2016 | Shimura | |

* cited by examiner

ANTENNA

BACKGROUND OF THE INVENTION

Field of the Invention

The present invention relates to an antenna.

Description of the Related Art

In recent years, a wireless communication function is mounted on various electronic devices. Such an electronic device on which the wireless communication function is implemented has been reduced in size year by year, and an antenna incorporated in the electronic device is also required to be arranged in a space as small as possible. Japanese Patent Application Laid-Open No. H09-69718 discloses a transmission line-type antenna having an antenna line in which one end is connected to a power supply unit and the other end is connected to a conductive ground plate as a small and thin antenna having matched impedance. Here, the antenna line described above is formed such that respective portions on both end sides are bent several times in a single plane and extends from a conductive ground plate and is formed such that the central part is close to the conductive ground plate at a predetermined distance to have a predetermined capacity.

As described above, there is a demand for reduction in size of an antenna incorporated in an electronic device. In addition, even when various objects such as a human body, a metal, or the like come close to the antenna, it is required to reduce change or deterioration of antenna characteristics. However, the conventional antenna described above does not sufficiently satisfy the requirement of being compact and having less change or deterioration of antenna characteristics. Accordingly, the present invention intends to provide a small antenna in which change or deterioration of antenna characteristics is suppressed.

SUMMARY OF THE INVENTION

To solve the problem described above, one aspect of an antenna according to the present invention includes: a feeding point; an antenna element unit having one end connected to the feeding point and the other end connected to a ground conductor; and a first conductive portion connected to the ground conductor, the antenna element unit has, between the one end and the other end, a second conductive portion having a shape in which a plurality of bent parts are formed, and at least a part of the antenna element unit and at least a part of the first conductive portion are electromagnetically coupled with each other.

Further features of the present invention will become apparent from the following description of exemplary embodiments with reference to the attached drawings.

DESCRIPTION OF THE EMBODIMENTS

Figure 1A:
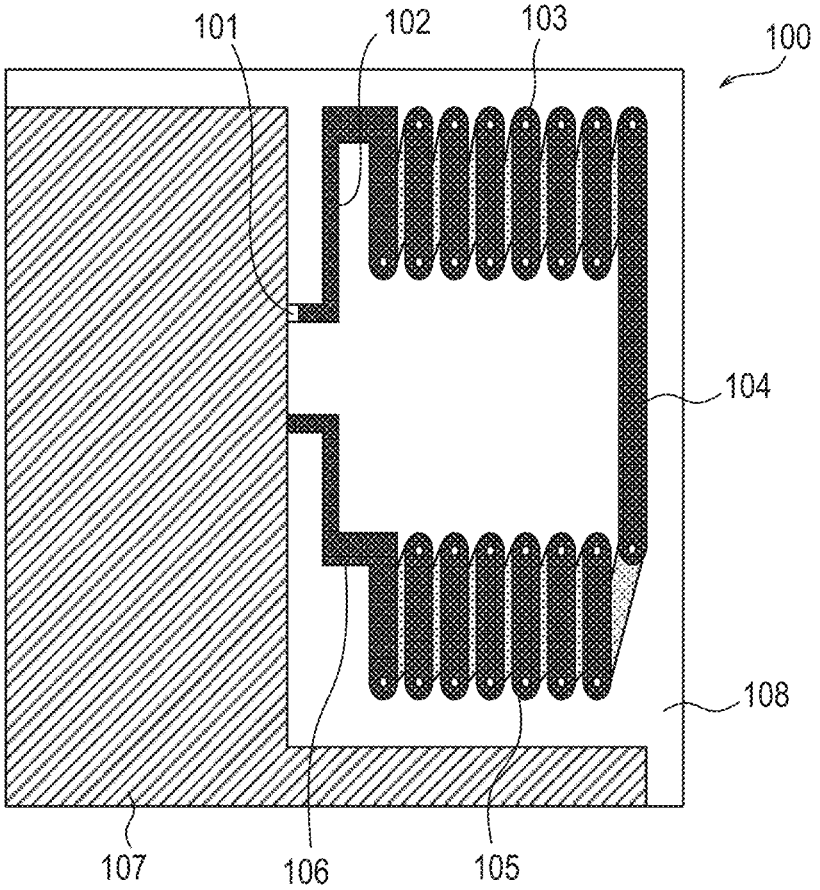
FIG. 1A and FIG. 1B illustrate a configuration example of an antenna according to a first embodiment.

The embodiments for implementing the present invention will be described in detail below with reference to the attached drawings. Note that each of the embodiments described below is an example as a solution in the present invention, which is to be appropriately modified or changed depending on a configuration or various conditions of a device to which the present invention is applied, and the present invention is not limited to the embodiments described below.

First Embodiment

In the present embodiment, an antenna used for a wireless communication function confirming to the standard of the wireless LAN (IEEE802.11b/g/n/ax) will be described. To support IEEE802.11b/g/n/ax, an antenna operating in a frequency band of the 2.4 GHz band is required. There is a demand for reduction in size of the antenna here to be incorporated in a casing of an electronic device that is a wireless communication device. Further, when a wireless communication function is incorporated in an electronic device, in general, an antenna region is secured by removing conductor from each layer of the wireless module substrates, and a printed pattern antenna is implemented on the antenna region. Note that a wireless module substrate is a hardware component having a wireless communication function, and a pattern antenna is an antenna formed by printing a copper foil pattern on a substrate. In such a pattern antenna, since the antenna can be formed on a wireless module substrate without additional antenna component such as a chip antenna, for example, the antenna can be formed at low cost.

Further, since a pattern antenna is printed on a wireless module substrate, the height of an antenna portion is the same as the height of the wireless module substrate surface. On the other hand, in an antenna in which an antenna component such as a chip antenna, for example, is implemented on the wireless module substrate the height of the antenna portion is higher by the height of the antenna component than the pattern antenna. Thus, in the pattern antenna, the height of the antenna portion can be lower than that of the antenna in which an antenna component such as a chip antenna is implemented, and the electronic device incorporating the antenna can be reduced in size.

Further, when an antenna is incorporated in an electronic device, the input impedance may decrease due to the influence of other components inside the electronic device, a casing exterior, or the like, and therefore antenna characteristics may vary or deteriorate in some cases. Further, when a user uses an electronic device incorporating an antenna, antenna characteristics may vary or deteriorate when the user's body comes close to the antenna. To solve such a problem, there is an antenna in which one end of the antenna element is a feeding point and the other end is connected to the antenna ground. Such an antenna is referred to as a folded monopole antenna or a transmission line antenna. Hereinafter, such an antenna will be referred to as a folded monopole antenna.

In the folded monopole antenna, the input impedance of the antenna can be set higher than that of a typical monopole antenna, and there is an advantage of being less affected by other components, a substrate, a casing exterior, or the like within the adjacent electronic device or a human body. In the present embodiment, the folded monopole antenna that is a pattern antenna formed on the substrate in which one end of an antenna element is a feeding point and the other end is connected to the antenna ground will be described. Note that the expression of forming "on the substrate" includes printing a pattern antenna to form an antenna element unit as described above rather than implementing antenna components on the substrate such as a chip antenna.

Antenna Configuration

Figure 1B:
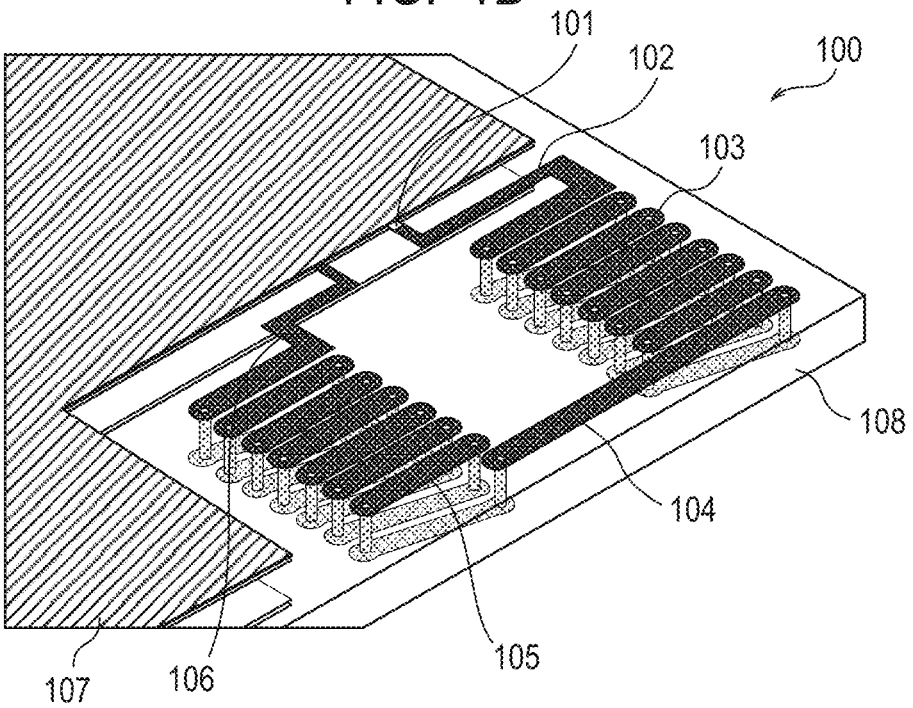

FIG. 1A is a front view illustrating a configuration example of an antenna 100 according to the present embodiment, and FIG. 1B is a perspective view illustrating a configuration example of the antenna 100 according to the present embodiment. The antenna 100 is formed on a wireless module substrate (hereinafter, simply referred to as a "substrate"), and FIG. 1A and FIG. 1B are enlarged views of an antenna region of the antenna 100. The antenna 100 has a feeding point 101, a conductive portion 102, a conductive portion 103, a conductive portion 104, a conductive portion 105, and a conductive portion 106. The feeding point 101 is a feeding point at which power is supplied to the antenna 100. The conductive portions 103 and the conductive portion 105 are helical-shaped conductive portions (helical conductive portions) formed on the substrate and are formed of patterns and via holes. The conductive portion 102 connects the feeding point 101 to one end of the conductive portion 103, which is a helical conductive portion. The conductive portion 104 connects the other end of the conductive portion 103, which is a helical conductive portion, to one end of the conductive portion 105, which is a helical conductive portion. The conductive portion 106 connects the other end of the conductive portion 105, which is a helical conductive portion, to a ground conductor 107 formed of a conductor.

The ground conductor 107 functions as a ground of the antenna (hereinafter, referred to as an antenna ground). While the ground conductor 107 is practically provided with various components to realize the wireless function, these various components are not taken into consideration in the present embodiment. In the following description, for the sake of simplicity, each of the conductive portions 102 to 106 is simply referred to as a "conductive portion" when it is not necessary to distinguish these conductive portions from each other in particular. Further, a conductive portion in which all the conductive portions 102 to 106 are connected (one conductor unit in which the conductive portions 102 to 106 are combined) is referred to as an "antenna element unit". In FIG. 1A and FIG. 1B, the antenna element unit (conductive portions 102 to 106) is indicated by black portions and the antenna ground (ground conductor 107) is indicated by a hatched portion.

The antenna element unit and the antenna ground are formed on a dielectric substrate 108 as the substrate described above. The dielectric substrate 108 is a Flame Retardant Type 4 (FR4) substrate, for example, and the relative dielectric constant is 4.2, for example. The dielectric substrate 108 is a multilayer substrate, and in the present embodiment, the case where the dielectric substrate 108 is a four-layer substrate will be described. Note that, while a resist (a protection film made of an insulator) exists on each conductive portion and the antenna ground, illustration of the resist is omitted in FIG. 1A and FIG. 1B. On the dielectric substrate 108, a part in which the ground conductor 107 is not present is an antenna region, and the size of the antenna region is 10 mm×5.5 mm in the present embodiment. The minimized antenna region allows for a wider implementation area of various components for implementing the wireless function, which leads to reduction in size of the substrate. Further, the thickness of the module including the substrate, the conductive portions, and the resist all together is approximately 0.9 mm. As an antenna of the 2.4 GHz band used in IEEE802.11b/g/n/ax, the size of the antenna region is smaller than that of the conventional technology.

In general, an antenna has a longer length and a greater size for a lower operating frequency. A folded monopole antenna in which one end of the antenna element is the feeding point and the other end is connected to the antenna ground typically operates in a frequency band in which the total length of the antenna element unit is a half wavelength (length of a half the wavelength) in the electric length. On the other hand, for example, an inverted F antenna also used as an antenna incorporated in an electronic device operates in a frequency band in which the total length of the element unit of the inverted F antenna is a quarter wavelength (length of a quarter the wavelength) in the electric length. Therefore, in comparison of the length of the antenna element unit of the inverted F antenna with that of the folded monopole antenna operating in the same frequency band, the folded monopole antenna requires approximately twice the length of the inverted F antenna. It is therefore important to reduce the size of the antenna region.

Note that the "wavelength" described above refers to a wavelength in a space in which the antenna is formed. For example, when an antenna is formed in free space, the wavelength refers to a wavelength in free space, and when the antenna is formed in an infinitely large dielectric, the wavelength is a wavelength in the dielectric. Further, when an antenna is formed on the dielectric substrate as with the present embodiment, the wavelength refers to a wavelength calculated by using the effective dielectric constant determined based on the air layer and the dielectric layer.

As described above, as illustrated in FIG. 1A and FIG. 1B, the antenna 100 according to the present embodiment has the feeding point 101 and the antenna element unit having one end connected to the feeding point 101 and the other end connected to the ground conductor 107. Further, the antenna element unit is configured to have two helical conductive portions. In such a way, between one end, which is the feeding point, and the other end connected to the antenna ground, the antenna element unit has a plurality of conductive portions having a shape in which a plurality of bent portions are formed. In addition, the antenna element unit is formed on the substrate. Specifically, the helical conductive portion is formed of patterns and via holes using a plurality of layers of the substrate. That is, at least a part of the antenna element unit is arranged in an inner layer of the substrate, and the helical conductive portion is formed such that the center axis thereof is parallel to the face of each layer of the substrate.

As discussed above, the antenna 100 in the present embodiment is a folded monopole antenna having an antenna element unit formed on the substrate. Further, the antenna 100 has a plurality of helical conductive portions. Thereby, a small antenna having less change or deterioration in antenna characteristics even when various objects come close to the antenna can be obtained. Further, since the helical-shaped conductive portion is formed by using multiple layers of the substrate, a longer antenna element unit can be formed in the same area compared to the antenna which is formed by using only a single layer of the substrate. Therefore, the area of the antenna region can be reduced, and the size of the antenna can be reduced. Further, appropriate arrangement of multiple helical conductive portions can reduce the size of the antenna compared to the case of a single helical portion.

Further, in the present embodiment, the dielectric substrate 108 is formed of a multilayer substrate (four-layer substrate). Further, the feeding point 101, the conductive portion 102, the conductive portion 104, the conductive portion 106, and the ground conductor 107 are formed on a first layer of the dielectric substrate 108. On the other hand, the conductive portion 103 and the conductive portion 105, which are the helical conductive portions, are formed by using the first layer and a third layer of the dielectric substrate 108 and via holes. That is, the antenna element unit is not arranged on a fourth layer (lowermost layer) of the dielectric substrate 108. When an antenna is incorporated in an electronic device, for example, contact of the antenna element unit to a metal forming other components inside the electronic device, a casing exterior, or the like may significantly change or deteriorate the antenna characteristics. Accordingly, in the present embodiment, the antenna element unit is not formed on the lowermost layer of the substrate but formed on the uppermost layer and the inner layer of the substrate. Thereby, even when the lowermost layer of the substrate is configured to come into contact with other components inside the electronic device, a casing exterior, or the like, since the antenna element unit does not directly come into contact with other components inside the electronic device, a casing exterior, or the like, and it is possible to suppress more appropriately deterioration of the antenna characteristics. Note that, when the uppermost layer of the substrate is configured to come into contact with other components inside the electronic device, a casing exterior, or the like, the antenna element unit can be formed in the uppermost layer of the substrate.

Note that, in the present embodiment, although being formed by using the faces of the first layer and the third layer of the dielectric substrate 108, the antenna element unit may be formed using the faces of the inner layers, for example, the second layer and the third layer. The arrangement of the antenna element unit in the inner layers of the substrate suppresses other components inside the electronic device, a casing exterior, or the like from coming close to the antenna element unit, and can effectively suppresses deterioration of antenna characteristics. Alternatively, deterioration of antenna characteristics may be more appropriately suppressed by forming the antenna element unit using the first layer and the fourth layer of the dielectric substrate 108 and via holes and further protecting the antenna element unit formed on the faces of the first layer and the fourth layer with a resist (a protection film made of an insulator). Thereby, since the antenna element unit can be formed by using the thickness from the first layer to the fourth layer of the substrate, the size of the antenna can be reduced compared to the case of forming the antenna element unit by using the inner layers described above. Further, the dielectric substrate 108 is not limited to the four-layer substrate and may be a six-layer substrate or an eight-layer substrate, for example. In such cases, the antenna element unit can be also formed using faces of any two layers excluding at least one of the lowermost layer and the uppermost layer. Furthermore, when the antenna region of the dielectric substrate 108 does not come into contact with other components inside the electronic device, a casing exterior, or the like, the dielectric substrate 108 may be a two-layer substrate.

Figure 2:
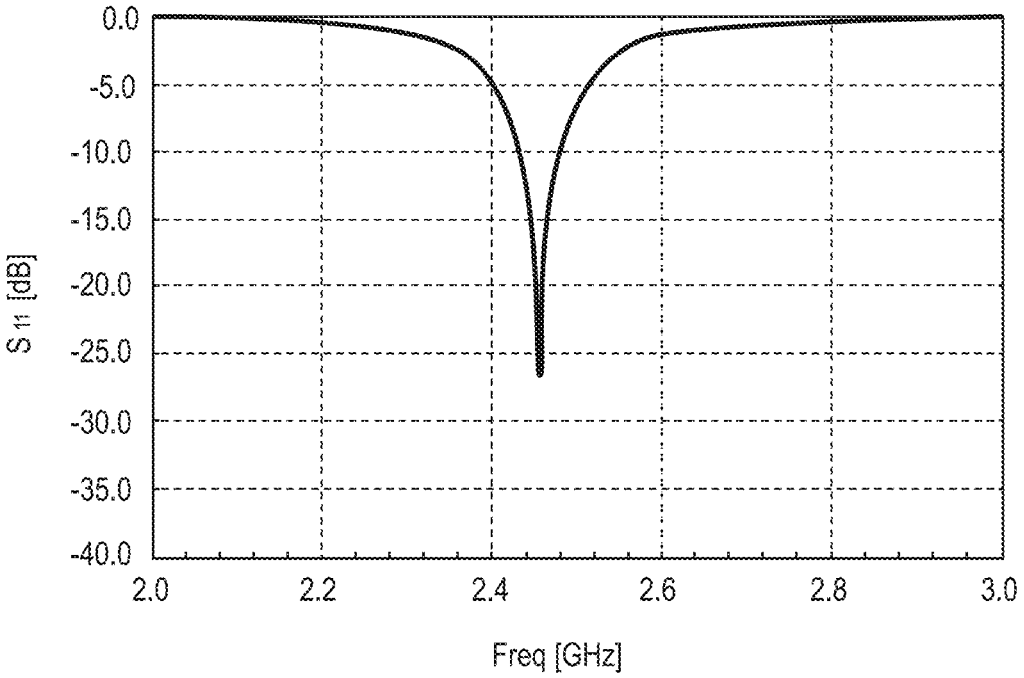
FIG. 2 illustrates a simulation result of reflection characteristics (S11) of the antenna illustrated in FIG. 1A and FIG. 1B.

FIG. 2 is a diagram illustrating a simulation result of reflection characteristics (S11) of the antenna 100 illustrated in FIG. 1A and FIG. 1B. FIG. 2 shows that sufficient reflection characteristics are obtained in the 2.4 GHz band used in IEEE802.11b/g/n/ax. That is, it is appreciated that the antenna 100 illustrated in FIG. 1A and FIG. 1B can appropriately operate as an antenna in a required operation band.

Another Configuration Example

Figure 3A:
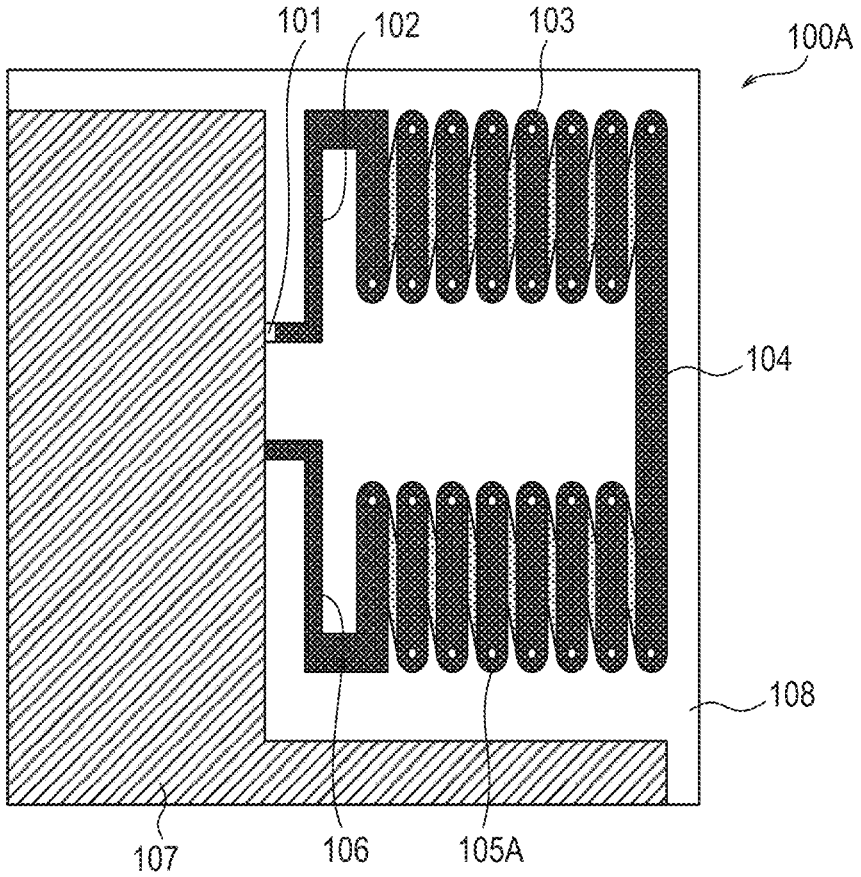
FIG. 3A and FIG. 3B illustrate another example of the antenna according to the first embodiment.
Figure 3B:
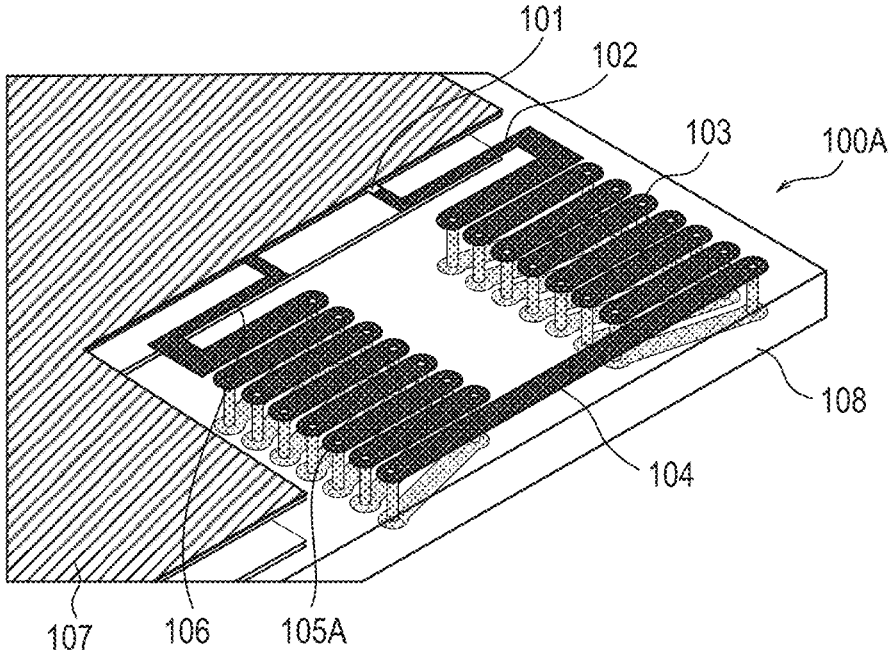

FIG. 3A and FIG. 3B are diagrams illustrating a configuration example of another antenna 100A according to the present embodiment. The antenna 100A has the same configurations as the antenna 100 except that the rotation direction of the conductive portion 105, which is the helical conductive portion in the antenna 100 illustrated in FIG. 1A and FIG. 1B, is different. Therefore, in FIG. 3A and FIG. 3B, portions having the same configuration as the antenna 100 are labeled with the same references as those in FIG. 1A and FIG. 1B, and portions having different configurations will be mainly described below. A conductive portion 105A is a helical conductive portion formed in a helical shape with patterns formed on a substrate and via holes in the same manner as the conductive portion 105 of FIG. 1A and FIG. 1B. The helical rotation directions are the same in the conductive portion 103 and the conductive portion 105 of the antenna 100 illustrated in FIG. 1A and FIG. 1B. On the other hand, the helical rotation directions are opposite between the conductive portion 103 and the conductive portion 105A of the antenna 100A illustrated in FIG. 3A and FIG. 3B.

Figure 4:
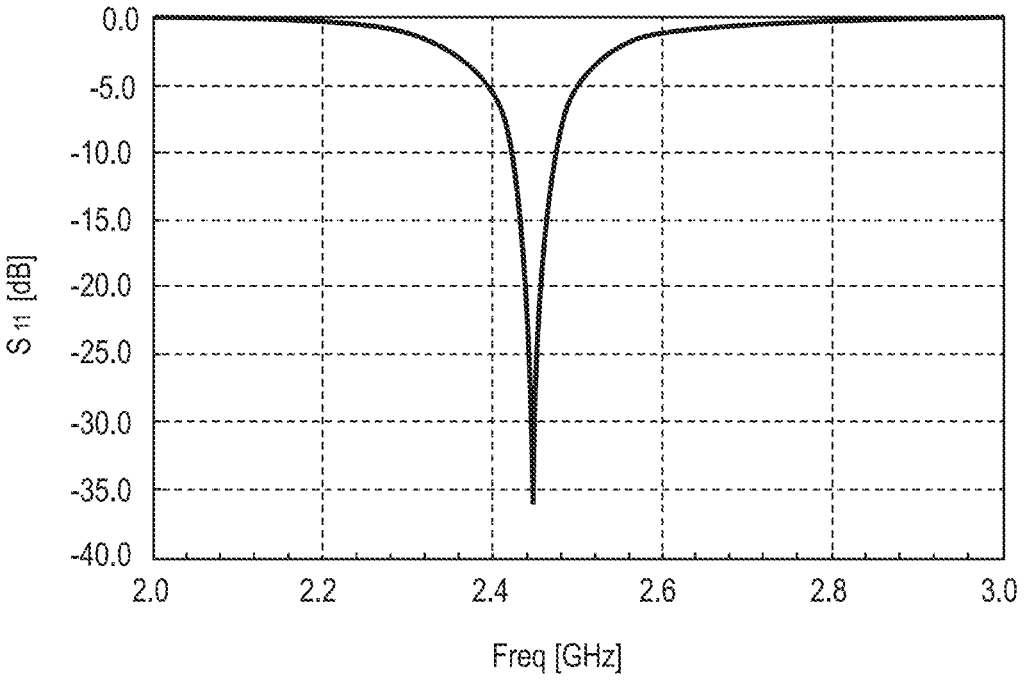
FIG. 4 illustrates a simulation result of reflection characteristics (S11) of the antenna illustrated in FIG. 3A and FIG. 3B.

FIG. 4 is a diagram illustrating a simulation result of reflection characteristics (S11) of the antenna 100A illustrated in FIG. 3A and FIG. 3B. FIG. 4 shows that sufficient reflection characteristics are obtained in the 2.4 GHz band used in IEEE802.11b/g/n/ax. That is, it is appreciated that the antenna 100A illustrated in FIG. 3A and FIG. 3B can appropriately operate as an antenna in a required operation band. As described above, it is appreciated that the antenna 100 illustrated in FIG. 1A and FIG. 1B and the antenna 100A illustrated in FIG. 3A and FIG. 3B both exhibit good characteristics as an antenna for the wireless LAN 2.4 GHz band. Further, it is appreciated that antenna characteristics do not significantly change due to the helical rotation directions of the helical conductive portions of the antenna element unit. Therefore, not only the rotation directions illustrated in FIG. 1A and FIG. 1B and FIG. 3A and FIG. 3B but also any rotation direction may be employed for the helical rotation direction of the helical conductive portion.

Another Configuration Example

Figure 5A:
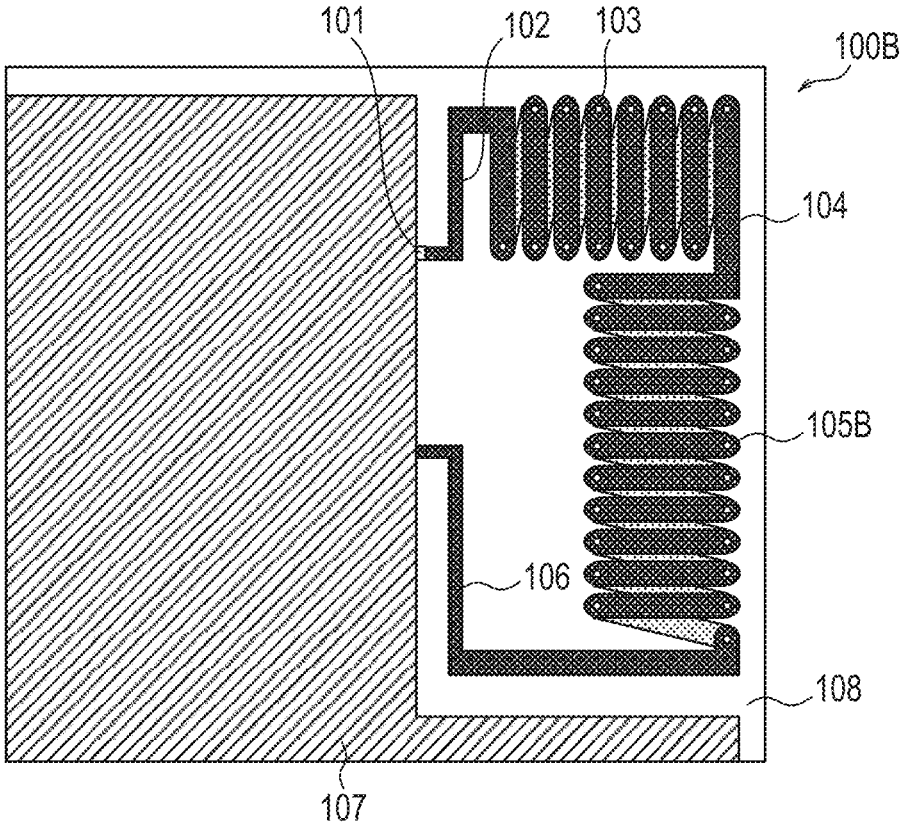
FIG. 5A and FIG. 5B illustrate another example of the antenna according to the first embodiment.
Figure 5B:
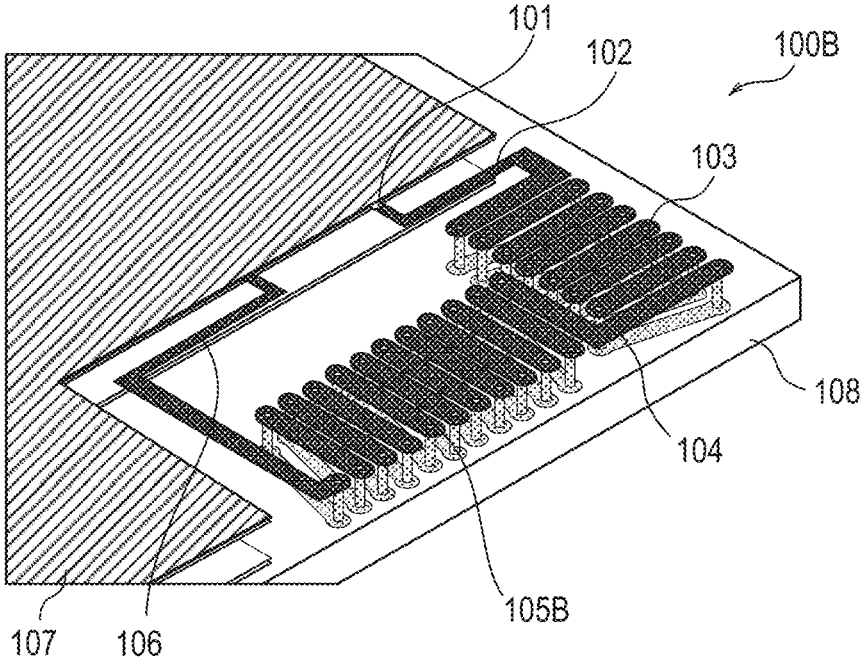

FIG. 5A and FIG. 5B are diagrams illustrating a configuration example of another antenna 100B according to the present embodiment. The antenna 100B has the same configuration as the antenna 100 except that the arranging direction of the conductive portion 105, which is the helical conductive portion in the antenna 100 illustrated in FIG. 1A and FIG. 1B, is different. Therefore, in FIG. 5A and FIG. 5B, the portions having the same configuration as the antenna 100 are labeled with the same reference numerals as those in FIG. 1A and FIG. 1B, and portions having different configuration will be mainly described below. A conductive portion 105B is a helical conductive portion formed in a helical shape with patterns formed on a substrate and via holes in the same manner as the conductive portion 105 of FIG. 1A and FIG. 1B. The conductive portion 103 and the conductive portion 105 of the antenna 100 illustrated in FIG. 1A and FIG. 1B are arranged in parallel. On the other hand, the conductive portion 103 and the conductive portion 105B of the antenna 100B illustrated in FIG. 5A and FIG. 5B are arranged to form a right angle.

Figure 6:
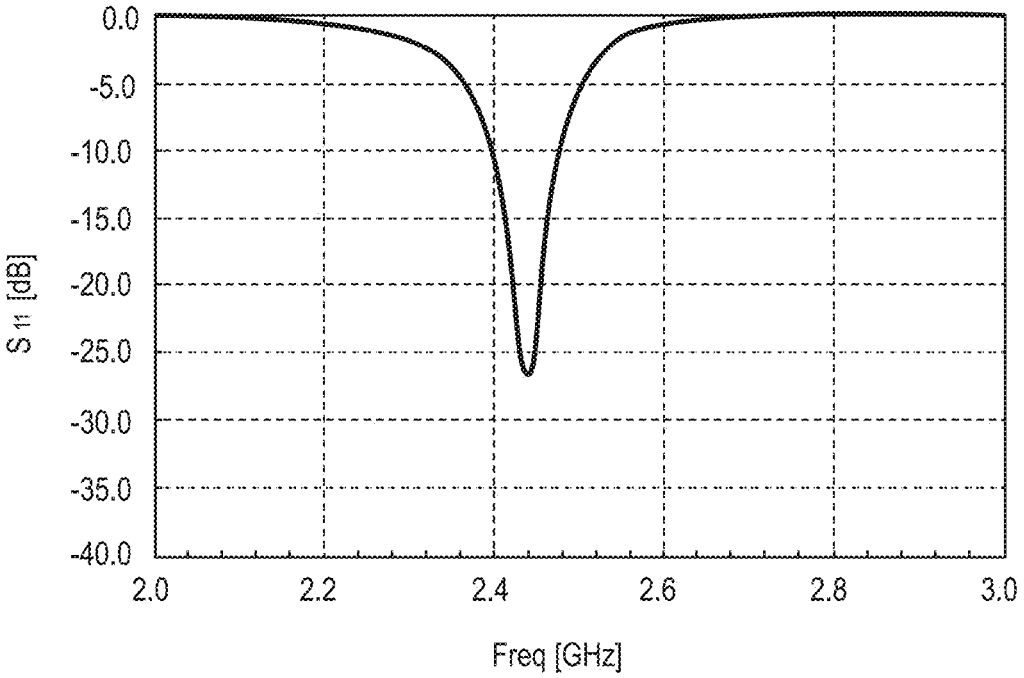
FIG. 6 illustrates a simulation result of reflection characteristics (S11) of the antenna illustrated in FIG. 5A and FIG. 5B.

FIG. 6 is a diagram illustrating a simulation result of reflection characteristics (S11) of the antenna 100B illustrated in FIG. 5A and FIG. 5B. FIG. 6 shows that sufficient reflection characteristics are obtained in the 2.4 GHz band used in IEEE802.11b/g/n/ax. That is, it is appreciated that the antenna 100B illustrated in FIG. 5A and FIG. 5B can operate appropriately as an antenna in a required operation band. As described above, it is appreciated that the antenna 100B illustrated in FIG. 5A and FIG. 5B exhibits good characteristics as an antenna for a wireless LAN 2.4 GHz band. Further, it is appreciated that antenna characteristics do not significantly change due to the arranging directions of the helical conductive portions of the antenna element unit. Therefore, not only the arranging directions illustrated in FIG. 1A and FIG. 1B, FIG. 3A and FIG. 3B, and FIG. 5A and FIG. 5B but also any arranging direction may be employed for the arranging direction of the helical conductive portion.

Modified Example

Note that, in the present embodiment, the antenna in which the antenna element unit has two helical conductive portions has been described. However, the number of the helical conductive portions of the antenna element unit is not limited to two. Since it is intended to reduce the size of the antenna region by forming helical conductive portions, the number of the helical conductive portions may be three or more. Further, in the present embodiment, the case where the helical-shaped conductive portion is used to reduce the size of the antenna region has been described. However, the shape of the conductive portion is not limited to the helical shape, and other shapes that can reduce the size of the antenna region, such as a spiral shape and a meander shape, may be used, for example. Furthermore, the combination of these shapes may be used for reducing the size of the antenna region.

Further, in the present embodiment, although the case where the antenna element unit is formed on the substrate using a pattern and a via hole has been described, the antenna element unit may be formed on the substrate by using other materials such as a sheet metal or a conductive wire, for example. Alternatively, the antenna element unit may be formed on the substrate by using a conductive wire inside a high-dielectric member such as a ceramic. That is, the expression of forming "on the substrate" also includes arranging the sheet metal, the conductive wire, or the like as described above. Further, in the present embodiment, only the feeding point is illustrated for power supply to the antenna, and a power supply line to the feeding point is not described in detail. However, such a power supply line is not particularly limited and may be a planar circuit represented by a microstrip line, a slot line, a coplanar line, or the like or a transmission line for transmitting electromagnetic waves such as a coaxial line, a waveguide, or the like, for example.

Second Embodiment

Next, a second embodiment of the present invention will be described. In the first embodiment described above, a folded monopole antenna having a plurality of helical conductive portions formed on the substrate in order to reduce the size of the antenna region has been described. In the second embodiment, a configuration that further reduces the size of the antenna will be described.

Antenna Configuration

Figure 7A:
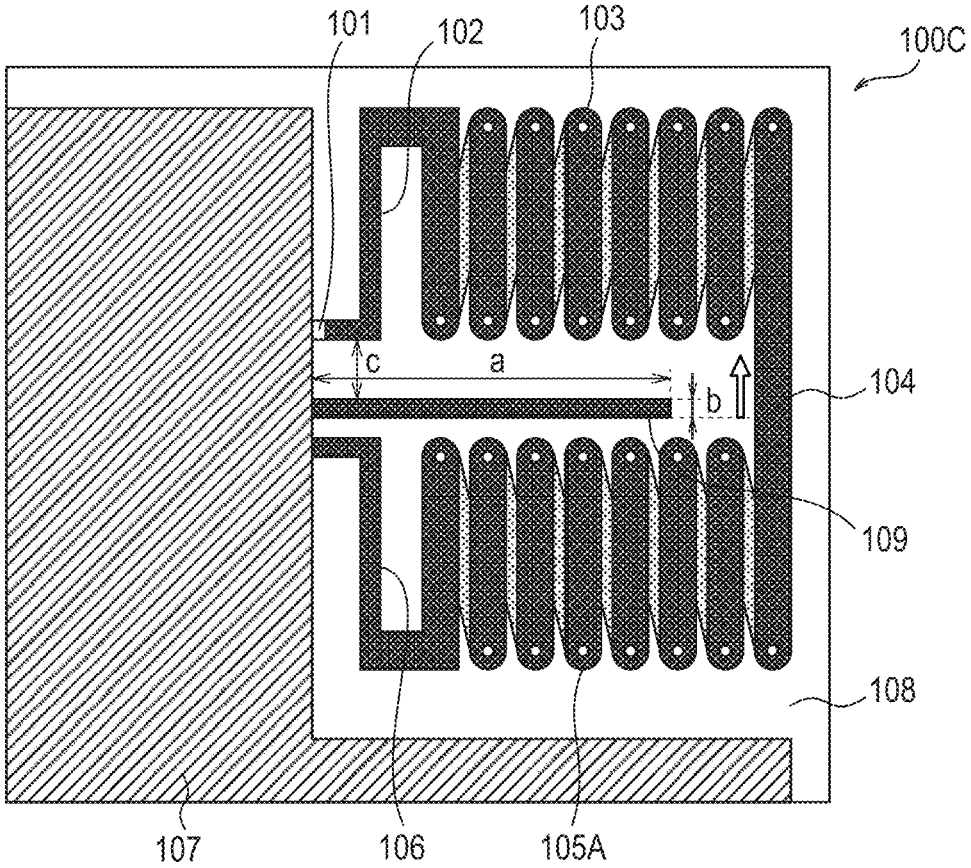
FIG. 7A and FIG. 7B illustrate a configuration example of an antenna according to a second embodiment.
Figure 7B:
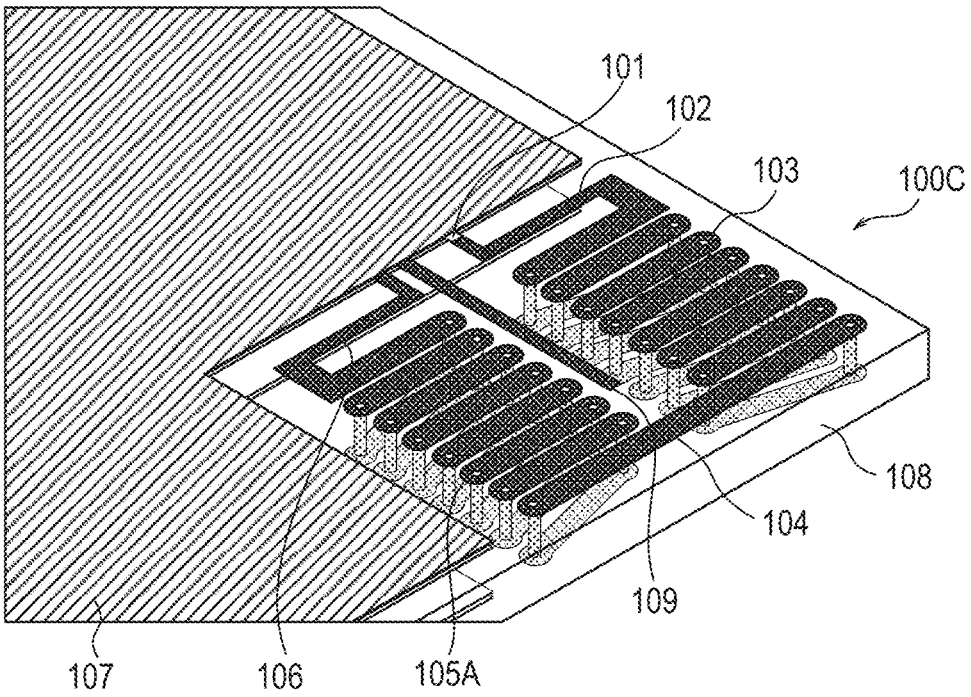

FIG. 7A and FIG. 7B are diagrams illustrating a configuration example of an antenna 100C in the present embodiment. The antenna 100C illustrated in FIG. 3A and FIG. 3B has the same configuration as the antenna 100A except that a ground element 109 is present for the antenna 100A. However, the size and the length of respective conductive portions are different between the antenna element unit in the antenna 100A in FIG. 3A and FIG. 3B and the antenna element unit in the antenna 100C in FIG. 7A and FIG. 7B. Further, the size of the antenna region in the antenna 100A and the size of the antenna region in the antenna 100C are also different, and the size of the antenna region in the antenna 100C is 7 mm×5.5 mm. In FIG. 7A and FIG. 7B, the portions having the same configuration as the antenna 100A are labeled with the same reference numerals as those in FIG. 3A and FIG. 3B, and portions having different configurations will be mainly described below.

The ground element 109 is a conductive portion connected to the antenna ground 107. The ground element 109 is formed on the substrate. In the present embodiment, it is assumed that the ground element 109 is formed with a pattern extending from the antenna ground 107 on the substrate. As illustrated in FIG. 7A and FIG. 7B, one end of the ground element 109 is connected to the antenna ground 107, and the ground element 109 is arranged so as to come close to the antenna element unit. The antenna element unit and the ground element 109 are electromagnetically coupled to each other by being arranged in close proximity to each other. The term "coupling" here represents coupling in an electromagnetic manner including electrostatic coupling (capacitive coupling), magnetic coupling (inductive coupling), or electromagnetic coupling in which both are mixed.

Figure 8:
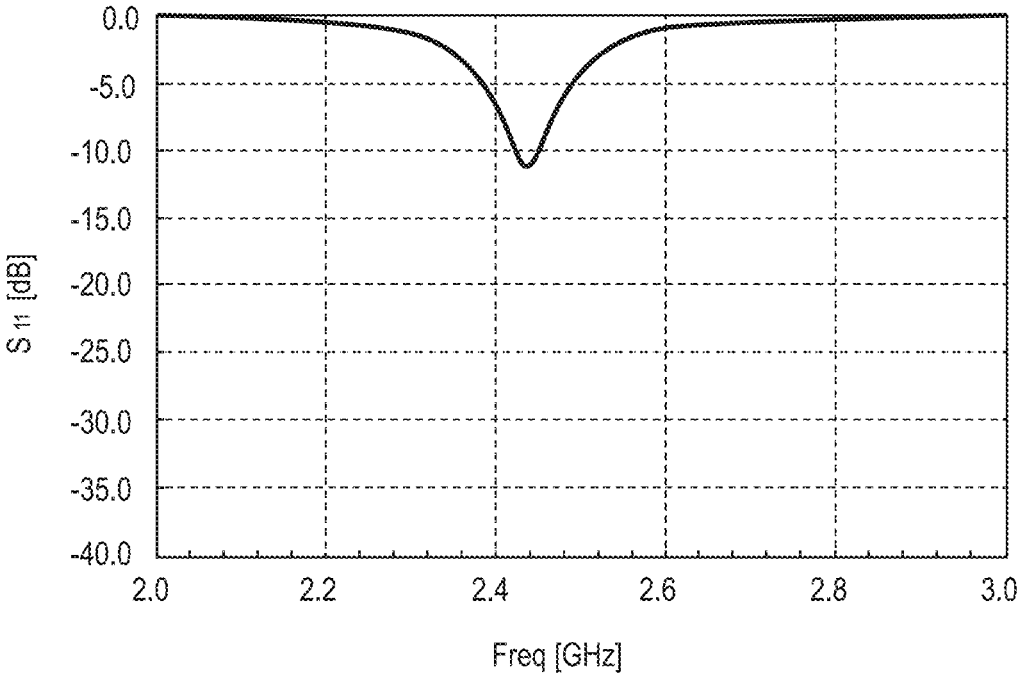
FIG. 8 illustrates a simulation result of reflection characteristics (S11) of the antenna illustrated in FIG. 7A and FIG. 7B.

FIG. 8 is a diagram illustrating a simulation result of reflection characteristics (S11) of the antenna 100C illustrated in FIG. 7A and FIG. 7B. FIG. 8 shows that sufficient reflection characteristics are obtained in the 2.4 GHz band used in IEEE802.11b/g/n/ax. That is, it is appreciated that the antenna 100C illustrated in FIG. 7A and FIG. 7B can appropriately operate as an antenna in a required operation band.

Role of Ground Element

Figure 9A:
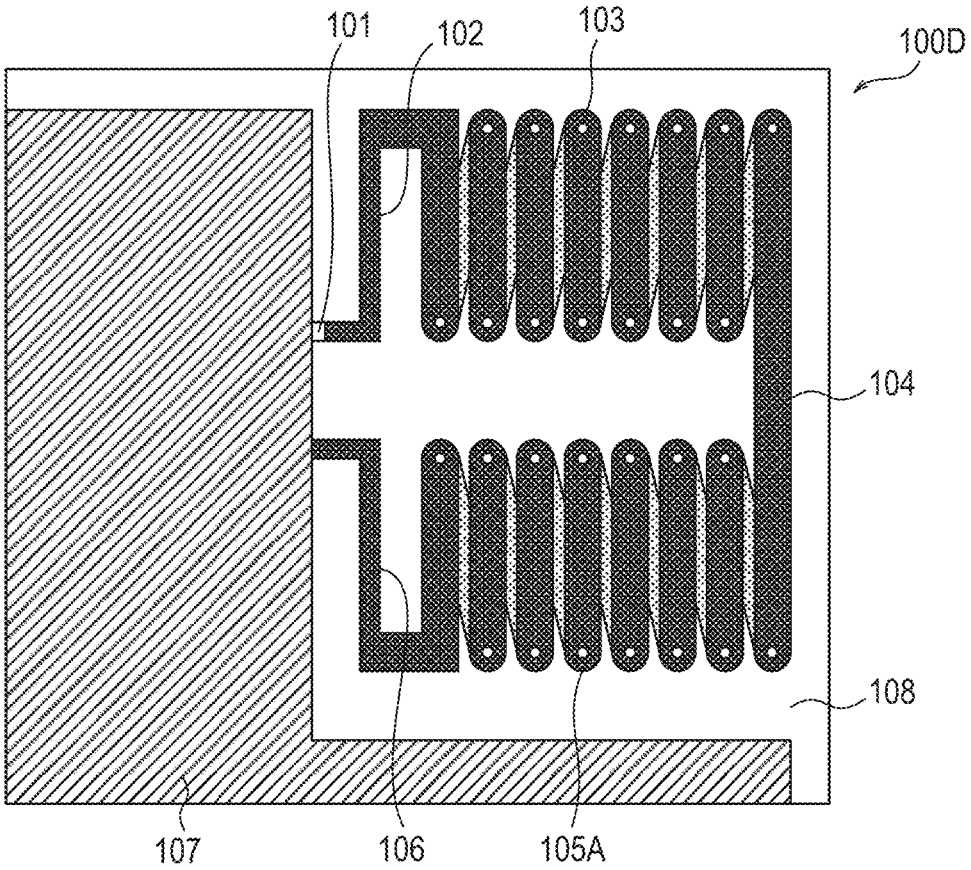
FIG. 9A and FIG. 9B illustrate a configuration example of an antenna of a comparative example.
Figure 9B:
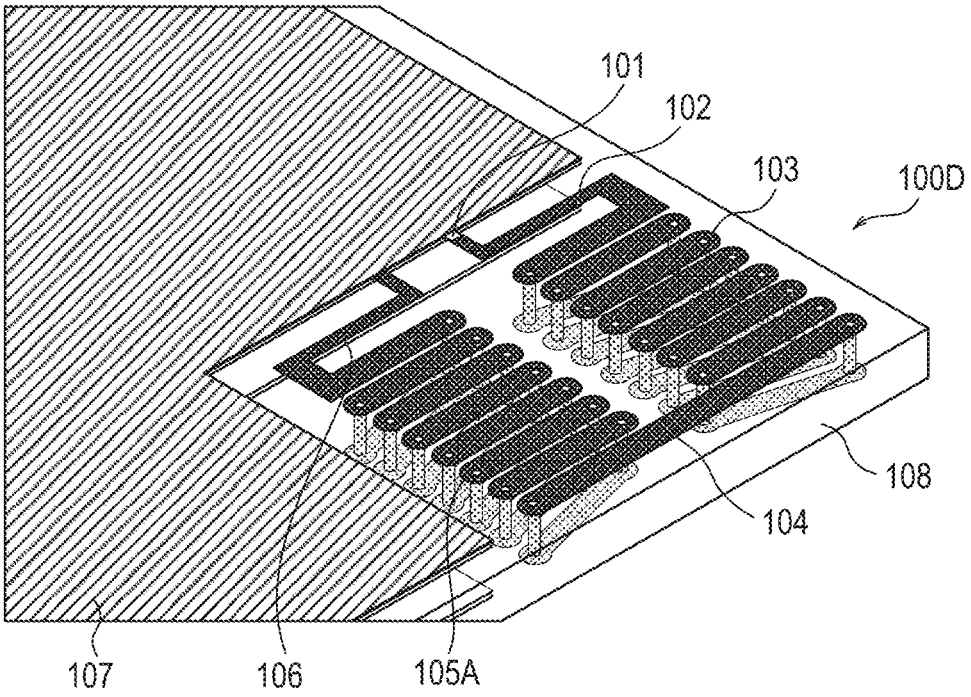
Figure 10:
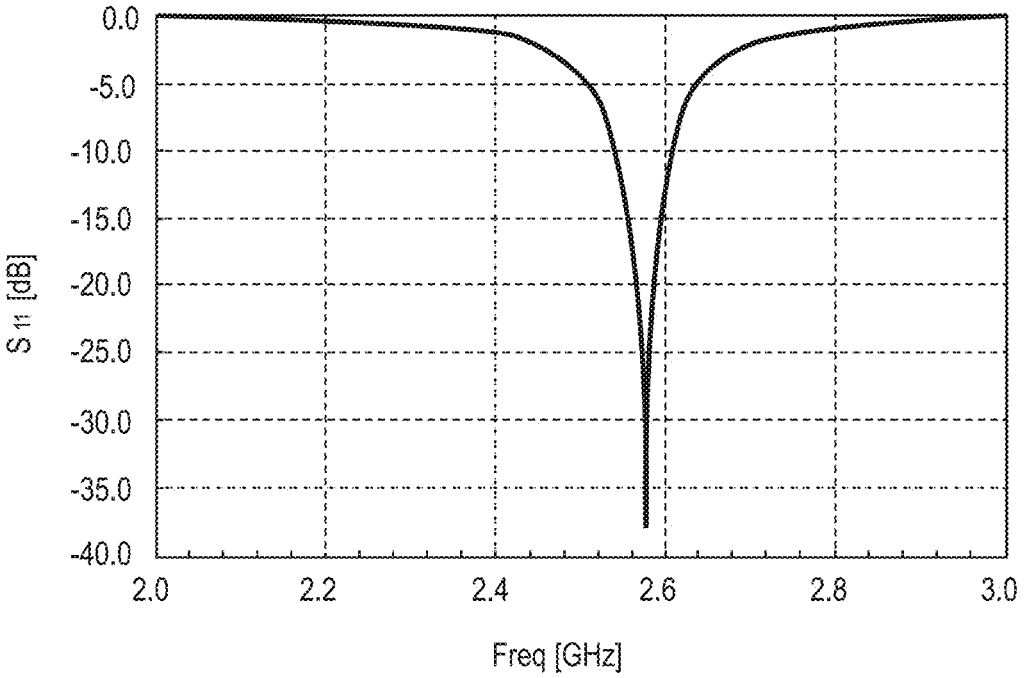
FIG. 10 illustrates a simulation result of reflection characteristics (S11) of the antenna illustrated in FIG. 9A and FIG. 9B.

FIG. 9A and FIG. 9B are diagrams of a configuration of an antenna 100D as a comparative example in which only the ground element 109 is removed from the antenna 100C of FIG. 7A and FIG. 7B. FIG. 10 is a diagram illustrating a simulation result of reflection characteristics (S11) of the antenna 100D illustrated in FIG. 9A and FIG. 9B. FIG. 10 shows that the antenna 100D operates as an antenna in a frequency band higher than the 2.4 GHz band.

Further, as can be seen from comparison between FIG. 8 and FIG. 10, the operating frequency band of the antenna 100C in which the ground element 109 is present (FIG. 7A and FIG. 7B) is shifted to a lower region than that of the antenna 100D in which the ground element 109 is absent (FIG. 9A and FIG. 9B). As described above, in general, an antenna has a longer length and a greater size for a lower operating frequency. According to the present embodiment, coupling between the antenna element unit and the ground element 109 can shift the resonance frequency to the lower side. That is, coupling described above enables the antenna to obtain the same resonance frequency as an antenna larger than the actual size (length) thereof. Therefore, the use of an antenna having the ground element 109 as with the present embodiment allows the sum of the lengths of the conductors of the antenna element unit to be shorter than a half the wavelength in the frequency band in which the antenna operates. As a result, the antenna region can be reduced, and the size of the antenna can be reduced.

Relationship between Length of Ground Element and Antenna Characteristics

Figure 11A:
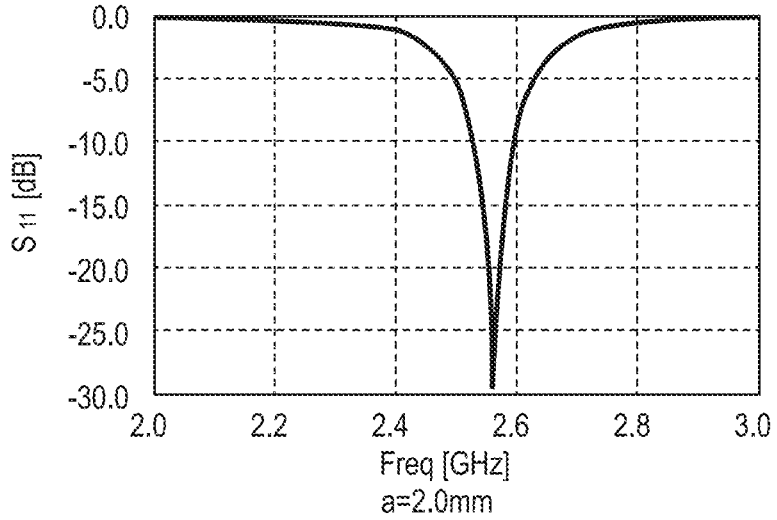
FIG. 11A, FIG. 11B and FIG. 11C illustrate reflection characteristics when the length of a ground element is changed.
Figure 11B:
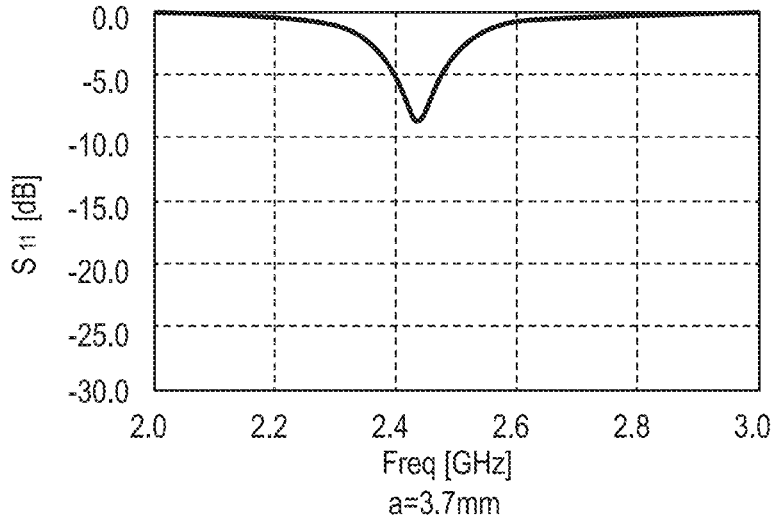
Figure 11C:
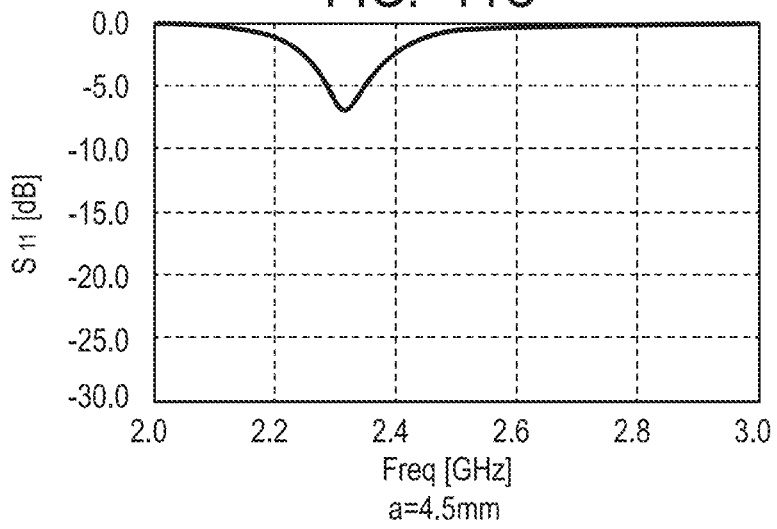

Next, the relationship between the length of the ground element and the antenna characteristics will be described. FIG. 11A to FIG. 11C are diagrams illustrating a simulation result of reflection characteristics when the width b and the arranging position c of the ground element are fixed, and the length a of the ground element is changed. FIG. 11A, FIG. 11B, and FIG. 11C here illustrate reflection characteristics when the length a is 2 mm, 3.7 mm, and 4.5 mm, respectively. Note that the width and the arranging position of the ground element of the antenna used in FIG. 11A to FIG. 11C are the same as those of the ground element 109 of the antenna 100C illustrated in FIG. 7A and FIG. 7B. The length a of the ground element of the antenna 100C illustrated in FIG. 7A and FIG. 7B is 3.7 mm. That is, FIG. 8 and FIG. 11B illustrate the same reflection characteristics.

The simulation results illustrated in FIG. 11A to FIG. 11C show that the resonance frequency of the antenna shifts to the lower side as the length a of the ground element increases. Accordingly, it is appreciated that the longer length a of the ground element results in stronger coupling between the antenna element unit and the ground element, and this provides the advantage of the capability of shifting the resonance frequency of the antenna to the lower side. Further, the simulation results illustrated in FIG. 11A to FIG. 11C show that the antenna operation bandwidth is narrower as the length a of the ground element increases.

Relationship between Width of Ground Element and Antenna Characteristics

Figure 12A:
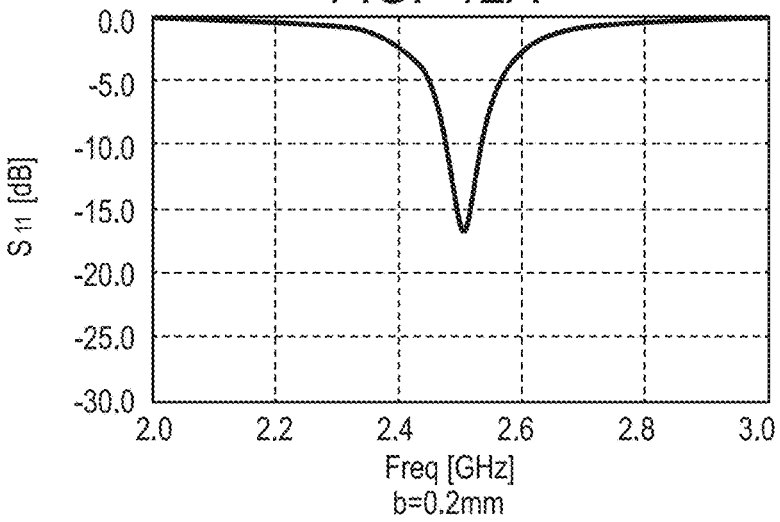
FIG. 12A, FIG. 12B and FIG. 12C illustrate reflection characteristics when the width of a ground element is changed.
Figure 12B:
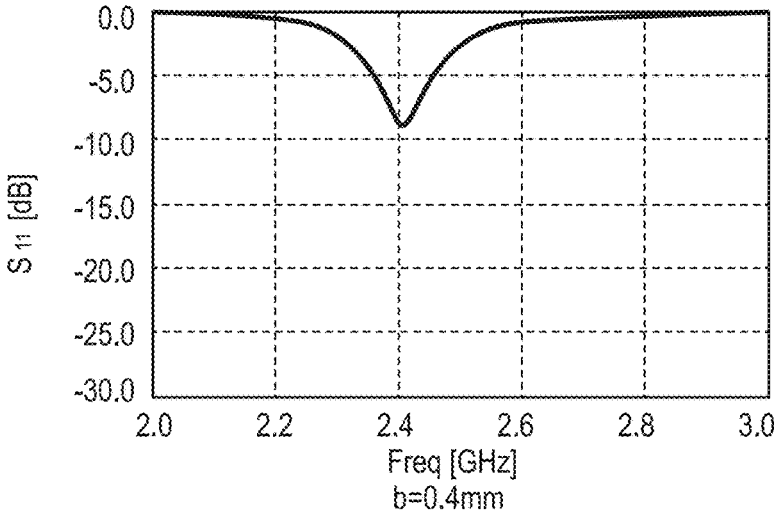
Figure 12C:
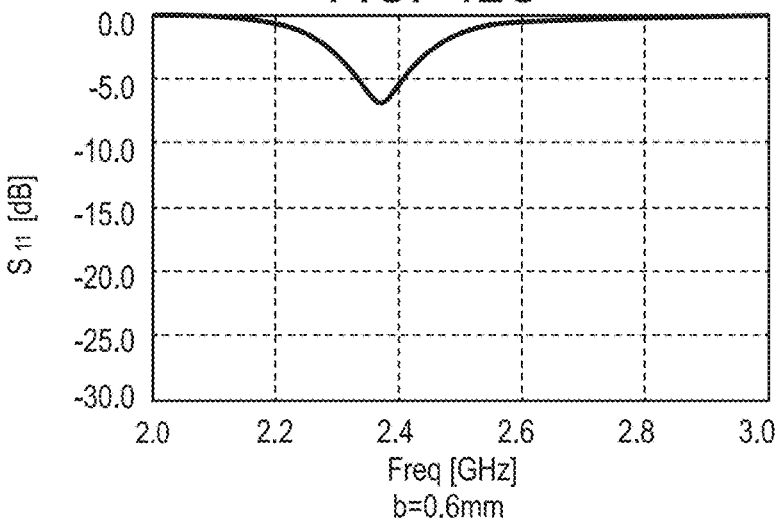

Next, the relationship between the width of the ground element and the antenna characteristics will be described. FIG. 12A to FIG. 12C are diagrams illustrating a simulation result of reflection characteristics when a length a and the arranging position c of the ground element are fixed, and the width b of the ground element is changed. FIG. 12A, FIG. 12B, and FIG. 12C here illustrate reflection characteristics when the width b is 0.2 mm, 0.4 mm, and 0.6 mm, respectively. Note that the width b is increased in the direction of the arrow depicted in FIG. 7A. The width b of the ground element 109 of the antenna 100C illustrated in FIG. 7A and FIG. 7B is 0.2 mm. However, the length a and the arranging position c of the ground element of the antenna used in FIG. 12A to FIG. 12C are different from those of the ground element 109 of the antenna 100C illustrated in FIG. 7A and FIG. 7B.

The simulation results illustrated in FIG. 12A to FIG. 12C show that the resonance frequency of the antenna shifts to the lower side as the width b of the ground element increases. Accordingly, it is appreciated that a wider width b of the ground element results in stronger coupling between the antenna element unit and the ground element, and this provides the advantage of the capability of shifting the resonance frequency of the antenna to the lower side. Further, the simulation results illustrated in FIG. 12A to FIG. 12C show that the antenna operation bandwidth is narrower as the width b of the ground element increases.

Relationship between Position of Ground Element and Antenna Characteristics

Figure 13A:
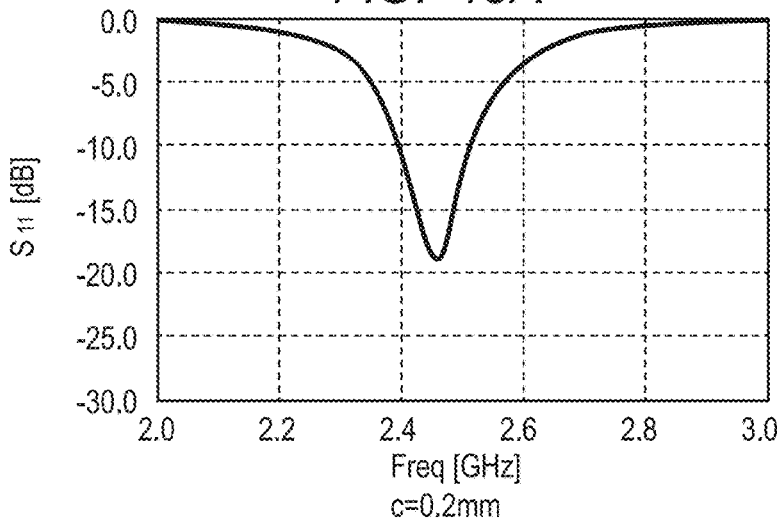
FIG. 13A, FIG. 13B and FIG. 13C illustrate reflection characteristics when the position of a ground element is changed.
Figure 13B:
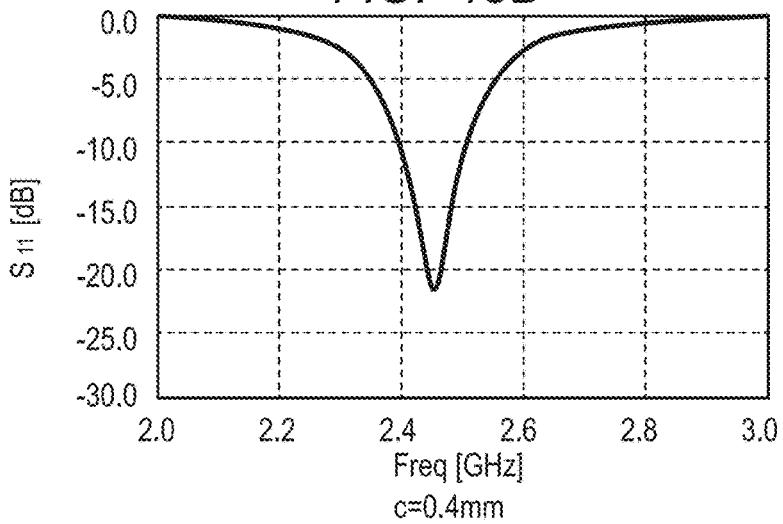
Figure 13C:
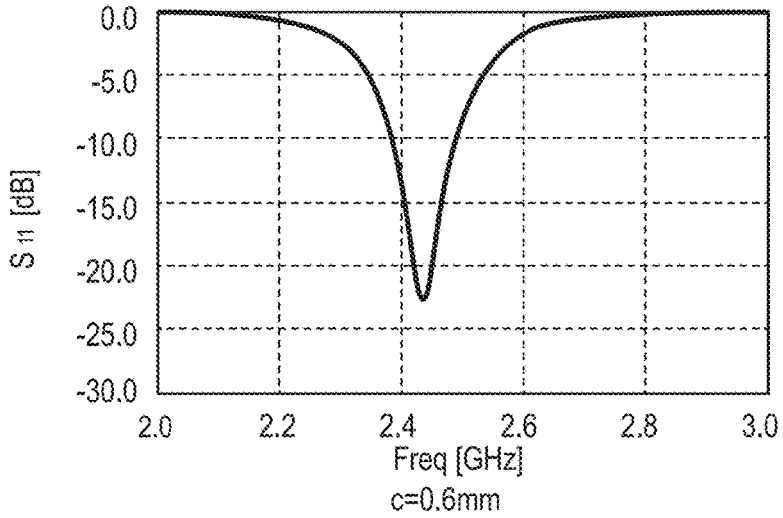

Next, the relationship between the position of the ground element and the antenna characteristics will be described. FIG. 13A to FIG. 13C are diagrams illustrating a simulation result of reflection characteristics when the length a and the width b of the ground element are fixed, and the arranging position c of the ground element is changed. FIG. 13A, FIG. 13B, and FIG. 13C here illustrate reflection characteristics when the arranging position c is 0.2 mm, 0.4 mm, and 0.6 mm, respectively. Note that the arranging position c of the ground element 109 of the antenna 100C illustrated in FIG. 7A and FIG. 7B is 0.6 mm. However, the length a and the width b of the ground element of the antenna used in FIG. 13A to FIG. 13C are different from those of the ground element 109 of the antenna 100C illustrated in FIG. 7A and FIG. 7B.

The simulation results illustrated in FIG. 13A to FIG. 13C show that the reflection coefficient, which is one of the antenna characteristics, is smaller as the arranging position c of the ground element increases. Therefore, it is appreciated that impedance matching of the antenna can be performed by changing the arranging position c of the ground element. As described above, the simulation results illustrated in FIG. 11A to FIG. 13C show that the operating frequency of the antenna shifts to the lower side as coupling between the antenna element unit and the ground element becomes stronger. Further, it is appreciated that at least one of the length a and the width b of the ground element can be used for adjusting the strength of coupling described above. Furthermore, it is appreciated that impedance matching of the antenna can be performed by changing the arranging position c of the ground element.

Therefore, when an actual antenna is designed, it is possible to adjust the coupling strength by adjusting the length a and the width b of the ground element described above, and it is possible to adjust the impedance by changing the arranging position c of the ground element. Thereby, an antenna operating in a desired frequency band can be designed, and the design can be flexible. When the resonance frequency is shifted to the lower side by strengthening the coupling as described above, however, a phenomenon in which the antenna operation bandwidth becomes narrower also occurs, and it is thus preferable to design an antenna so as to reduce the size while satisfying the necessary antenna operation bandwidth.

As described above, the antenna 100C in the present embodiment has the feeding point 101, the antenna element unit having one end connected to the feeding point 101 and the other end connected to the ground conductor 107, and the ground element 109. Further, at least a part of the antenna element unit and at least a part of the ground element 109 are electromagnetically coupled to each other. As described above, the antenna 100C in the present embodiment is a folded monopole antenna having the antenna element unit formed on the substrate. Further, the antenna 100C has at least one helical conductive portion. Thereby, a small antenna having less change and deterioration in antenna characteristics even when various objects come close to the antenna can be obtained. Furthermore, the antenna 100C of the present embodiment has the ground element 109. Therefore, the operating frequency band can be shifted to the lower side as compared to the antenna without the ground element 109. Therefore, the sum of the lengths of the conductors of the antenna element unit can be shorter than a half the wavelength of the desired operating frequency. As a result, the antenna region can be reduced, and the size of the antenna can be further reduced.

Further, it is possible to adjust the strength of coupling between the antenna element unit and the ground element 109 by adjusting at least one of the length and the width of the ground element 109. Furthermore, it is possible to adjust the impedance by adjusting the arranging position of the ground element 109. Therefore, desired antenna characteristics can be easily and appropriately obtained, and a thin and small antenna with a high design flexibility can be realized.

Modified Examples

In the embodiments described above, although the case where the shape of the ground element 109 is rectangle illustrated in FIG. 7A and FIG. 7B has been described, the shape of the ground element 109 is not limited to that described above. The ground element 109 may have any shape that is connected to the antenna ground 107 and is in the proximity of the antenna element unit. Therefore, the shape of the ground element 109 may be round, triangular, polygonal, or the like, for example. Further, although the case where the ground element 109 illustrated in FIG. 7A and FIG. 7B is arranged in the inner region of the antenna element unit surrounded by the antenna element unit has been described, the arranging position is not limited to that described above. For example, the ground element 109 may be arranged in a region which is outside the antenna element unit and is not surrounded by the antenna element unit. Note that, when the ground element 109 is arranged in the inner part surrounded by the antenna element unit, the advantage of reduction in the size of the antenna can be obtained compared to the case where the ground element 109 is arranged in an external region that is not surrounded by the antenna element unit.

Furthermore, in the present embodiment, although the case where the single ground element 109 is formed on the dielectric substrate 108 has been described, a plurality of ground elements may be formed. Further, while the case where the ground element 109 is formed on the first layer of the dielectric substrate 108 has been described, the ground element 109 may be formed on any other layers. Further, as seen in an antenna 100E illustrated in FIG. 14A and FIG. 14B, a ground element 109E may be arranged in the inner part of the helical conductive portion of the conductive portion 105A. The ground element 109E here is arranged in the second layer, which is the inner layer of the dielectric substrate 108. In such a case, at least a part of the ground element 109E is arranged to overlap at least a part of the conductive portion 105A, which is a helical conductive portion when viewed from the direction perpendicular to the face of the substrate.

Figure 14A:
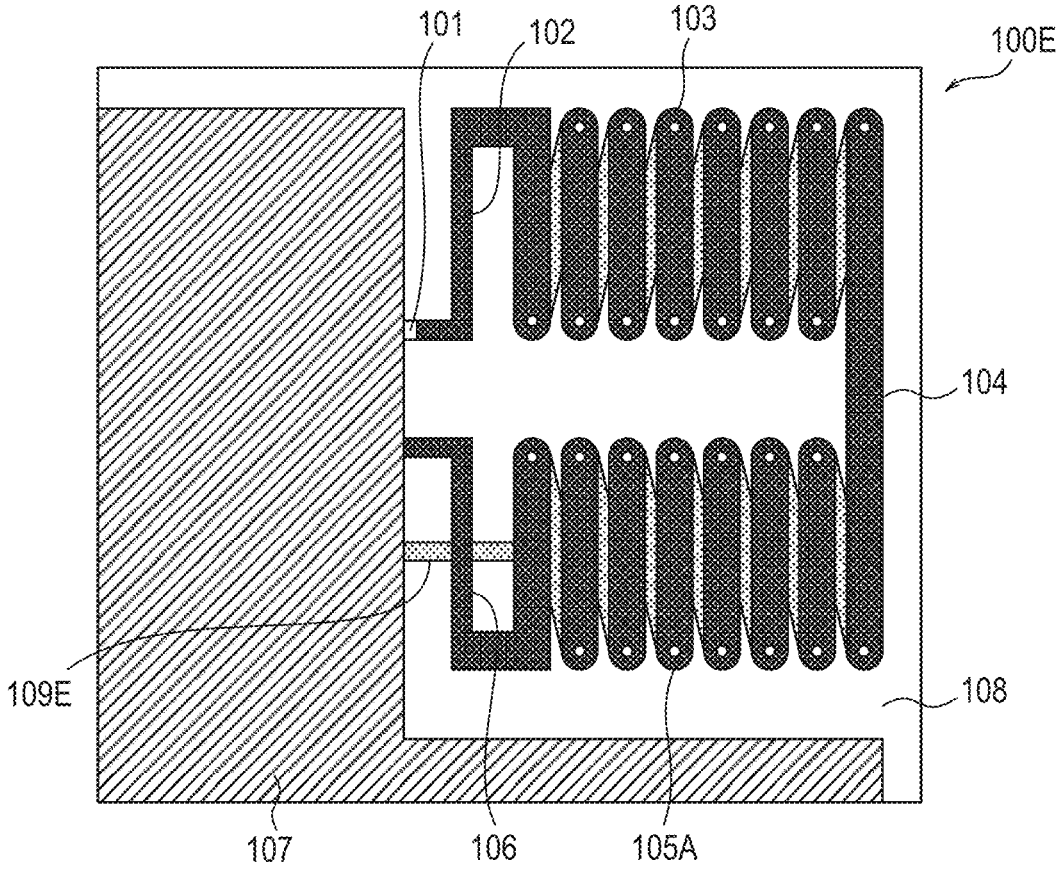
FIG. 14A and FIG. 14B illustrate another example of the antenna according to the second embodiment.
Figure 14B:
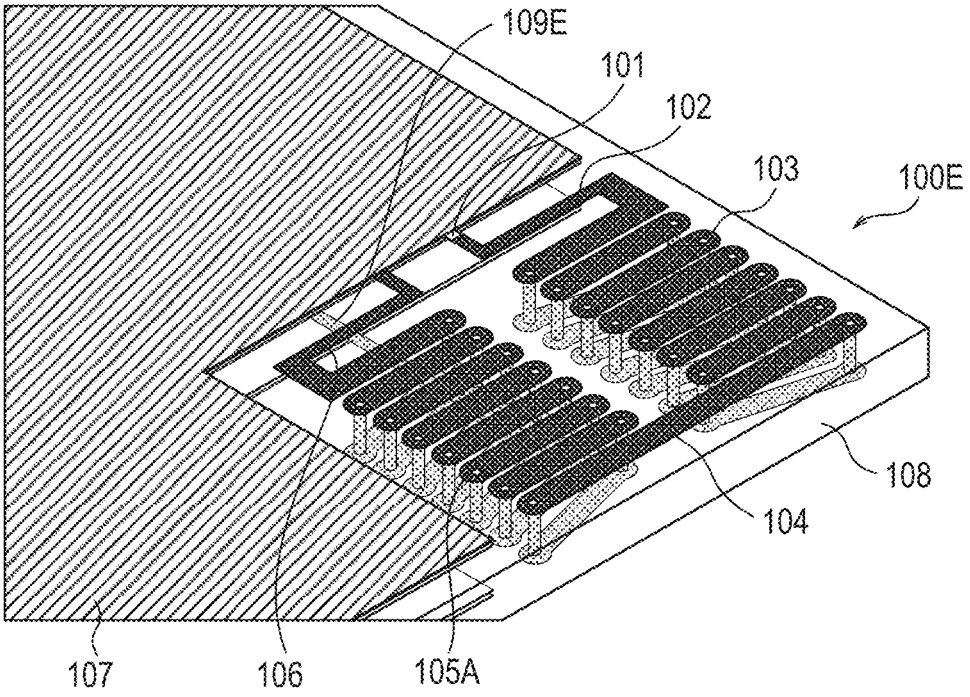
Figure 15:
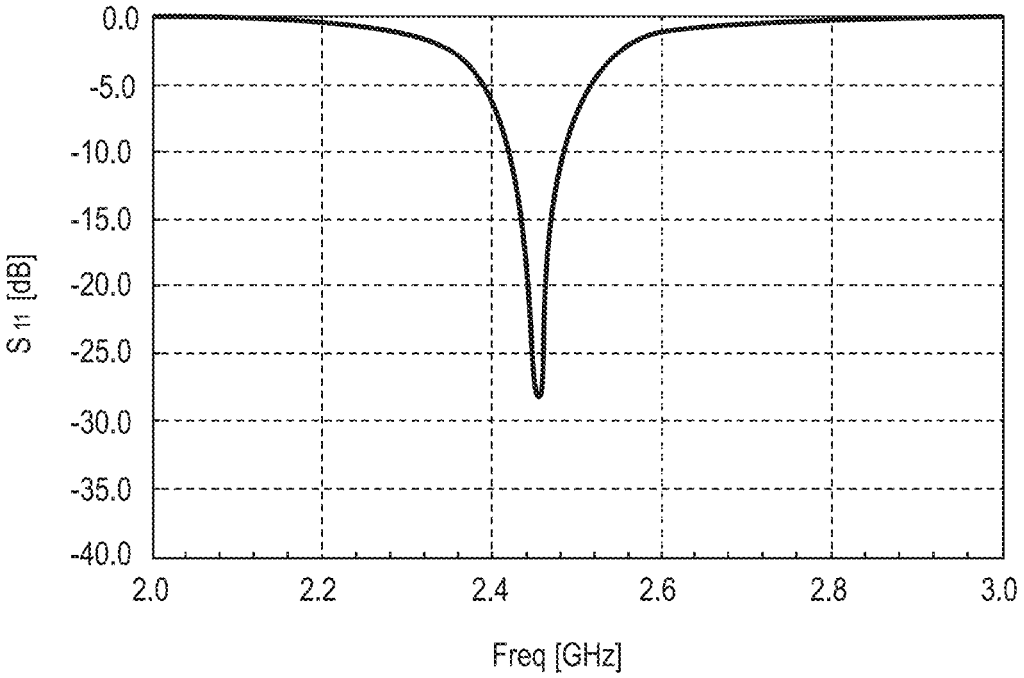
FIG. 15 illustrates a simulation result of reflection characteristics (S11) of the antenna illustrated in FIG. 14A and FIG. 14B.

FIG. 15 is a diagram illustrating a simulation result of reflection characteristics (S11) of the antenna 100E illustrated in FIG. 14A and FIG. 14B. FIG. 15 shows that sufficient reflection characteristics are obtained in the 2.4 GHz band used in IEEE802.11b/g/n/ax. That is, it is appreciated that the antenna 100E illustrated in FIG. 14A and FIG. 14B can appropriately operate as an antenna in a required operation band.

In comparison of the antenna characteristics of the antenna 100C illustrated in FIG. 7A and FIG. 7B with the antenna 100E illustrated in FIG. 14A and FIG. 14B, FIG. 8 and FIG. 15 show that both appropriately operate as an antenna in the 2.4 GHz band. Further, it is appreciated that, in the 2.4 GHz band in which the antenna is operated, the reflection coefficient of the reflection characteristics (FIG. 15) of the antenna 100E illustrated in FIG. 14A and FIG. 14B is smaller than that of the reflection characteristics (FIG. 8) of the antenna 100C illustrated in FIG. 7A and FIG. 7B. That is, it is appreciated that the antenna 100E illustrated in FIG. 14A and FIG. 14B is more preferable as an antenna.

Further, in comparison of the configurations of the antenna 100C illustrated in FIG. 7A and FIG. 7B with the antenna 100E illustrated in FIG. 14A and FIG. 14B, the arranging positions of the ground elements and the lengths of the ground elements are different from each other. The ground element 109 in FIG. 7A and FIG. 7B is arranged in the inner part of the antenna element unit surrounded by the antenna element unit, and the length of the ground element 109 is 3.7 mm. On the other hand, the ground element 109E in the FIG. 14A and FIG. 14B is arranged in the inner part of the helical conductive portion of the conductive portion 105A, which is a part of the antenna element unit, and the length of the ground element 109E is 2.6 mm That is, the ground element 109E of the FIG. 14A and FIG. 14B is shorter than the ground element 109 of FIG. 7A and FIG. 7B. Note that the width of each ground element is 0.2 mm and is the same.

As illustrated in FIG. 14A and FIG. 14B, the distance between the conductive portion 105A, which is a part of the antenna element unit, and the ground element 109E can be reduced by arranging the ground element 109E inside the helical conductive portion of the conductive portion 105A. Thereby, the ground element 109E and the conductive portion 105A can be electromagnetically coupled with each other. Further, the conductive portion 105A structured to surround the periphery of the ground element 109E increases a portion in which the ground element 109E and the conductive portion 105A are close to each other. This can cause strong coupling between the ground element 109E and the conductive portion 105A. Therefore, even when the length of the ground element is shorter than that of the ground element 109 of FIG. 7A and FIG. 7B, coupling that is stronger than or equal to that of the ground element 109 can be generated, and the size of the antenna can be effectively reduced.

Figure 16:
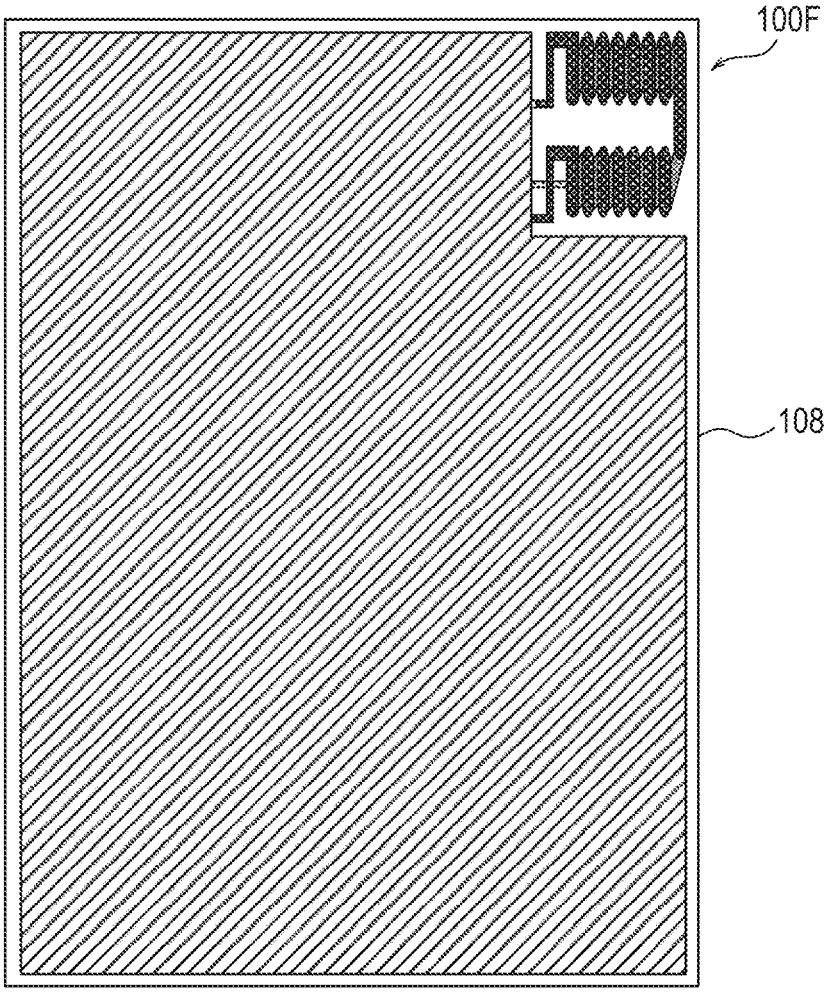
FIG. 16 is a diagram illustrating a configuration of the entire wireless module substrate.

Further, the configuration of the antenna element unit of the antenna having the ground element is not limited to the configurations illustrated in FIG. 7A and FIG. 7B and FIG. 14A and FIG. 14B. As with an antenna 100F of FIG. 16, for example, the rotation direction of the helical conductive portion corresponding to the conductive portion 105A of the antenna 100E illustrated in FIG. 14A and FIG. 14B may be configured to be the opposite direction to that of the conductive portion 105A. FIG. 16 here is a diagram illustrating the entire wireless module substrate on which the antenna 100F is implemented. In FIG. 16, the region in which the antenna 100F is arranged is the antenna region, and the antenna configuration diagrams illustrated in FIG. 1A and FIG. 1B, FIG. 3A and FIG. 3B, FIG. 5A and FIG. 5B, FIG. 7A and FIG. 7B, FIG. 9A and FIG. 9B, and FIG. 14A and FIG. 14B each are an enlarged view of this antenna region. As illustrated in FIG. 16, the antenna region can be arranged at a corner of the wireless module substrate. However, the arranging position of the antenna region is not limited to that described above and may be any position on the wireless module substrate.

Further, the configuration of the antenna element unit of the antenna having the ground element may be configured as illustrated in FIG. 5A and FIG. 5B. In addition, the number of the helical conductive portions forming the antenna element unit is not limited to two and may be one or three or more. Further, the conductive portion forming the antenna element unit is not limited to the helical conductive portion and may be a conductor in any other shapes. For example, other shapes that can reduce the size of the antenna region, such as a spiral shape and a meander shape, may be used. Furthermore, the combination of these shapes may be used for reducing the size of the antenna region.

Figure 17A:
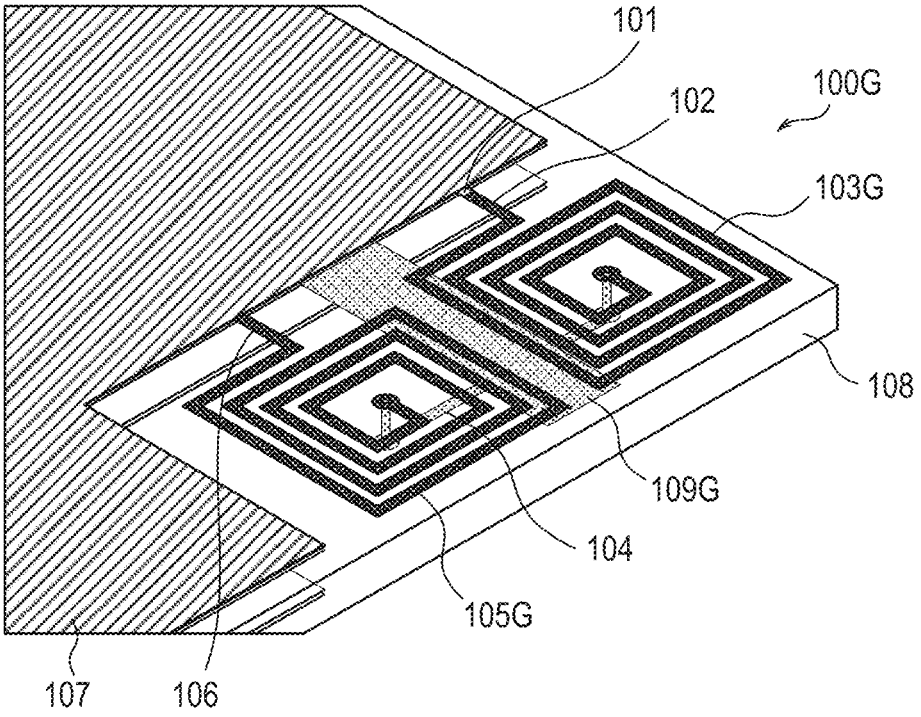
FIG. 17A and FIG. 17B illustrate another example of the antenna according to the second embodiment.
Figure 17B:
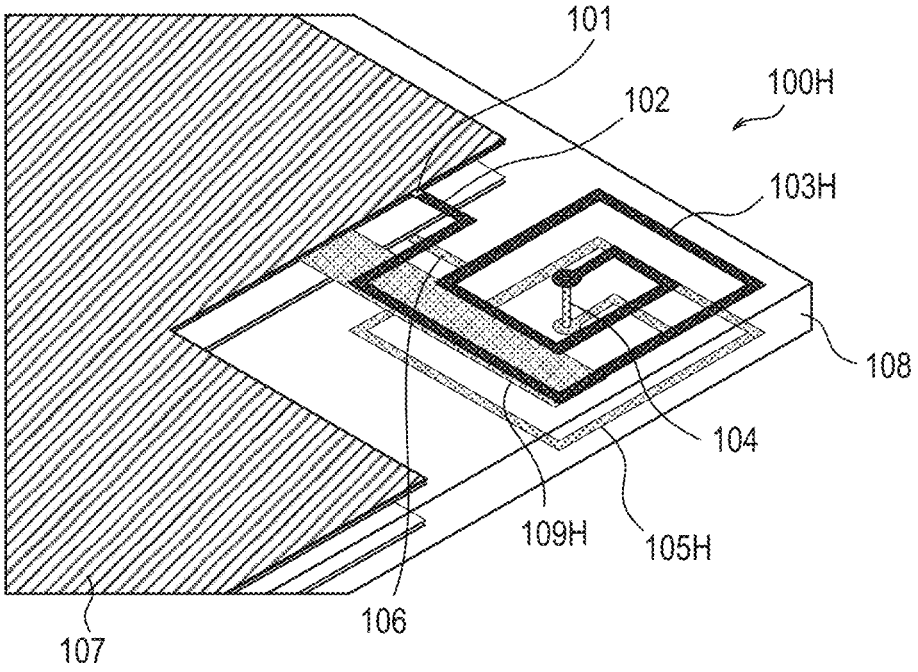

FIG. 17A and FIG. 17B are diagrams illustrating an antenna using a spiral conductive portion. In an antenna 100G illustrated in FIG. 17A, a plurality of spiral conductive portions (103G, 105G) are formed in the first layer of the dielectric substrate 108 and connected to each other to reduce the size. A ground element 109G is formed in a layer (second layer) different from the layer (first layer) in which each spiral conductive portion (103G, 105G) is formed and is configured so as to partially overlap each spiral conductive portion when viewed from the direction perpendicular to the face of the substrate. Thereby, strong coupling between the ground element 109G and the antenna element unit can be obtained, and the same advantages as in the ground element in FIG. 7A and FIG. 7B and FIG. 14A and FIG. 14B described above can be obtained.

In an antenna 100H illustrated in FIG. 17B, spiral conductive portions (103H, 105H) are formed in the first layer and the fourth layer of the substrate 108, respectively, and connected to each other to reduce the size. The ground element 109H is formed in a layer (second layer) interposed between the layers (first layer and fourth layer) in which respective spiral conductive portions (103H and 105H) are formed. The ground element 109H is then configured so as to partially overlap each spiral conductive portion when viewed from the direction perpendicular to the face of the substrate. Thereby, strong coupling between the ground element 109H and the antenna element unit can be obtained, and the same advantages as in the ground element in FIG. 7A and FIG. 7B and FIG. 14A and FIG. 14B described above can be obtained.

Note that the arranging position of the spiral conductive portion is not limited to the position illustrated in FIG. 17A and FIG. 17B and may be a different position. Further, in FIG. 17A and FIG. 17B, although the case where the antenna element unit has two spiral conductive portions has been described, the number of the spiral conductive portion included in the antenna element unit is not limited to two. Since it is intended to reduce the size of the antenna region by forming the spiral conductive portion, the number of the spiral conductive portion may be one or three or more. Further, the rotation direction of the spiral conductive portion is not limited to the direction illustrated in FIG. 17A and FIG. 17B and may be a different rotation direction. Further, the antenna element unit may be configured such that the helical conductive portion and the spiral conductive portion are connected to each other.

Another Embodiment

In each of the embodiments described above, although the antenna operating in the 2.4 GHz band used in IEEE802.11b/g/n/ax has been described, an antenna operating not only in the 2.4 GHz band but also in other frequency bands can be designed in the same manner. As described above, a folded monopole antenna is an antenna operating in a frequency band in which the total length of the antenna element unit is a half wavelength (length of a half the wavelength) in the electrical length. Therefore, an antenna operating in a desired frequency band can be configured by setting the antenna element unit to an appropriate length corresponding to the frequency and by appropriately adjusting the arranging position, the length, the width, or the like of the ground element. For example, an antenna in the 5 GHz band used in IEEE802.11a/n/ac/ax or in an antenna in the 900 MHz band used by IoT can be also realized. Since the wavelength of electromagnetic waves in the MHz band is longer than that in a GHz band in general, the antenna is larger than the antenna in the GHz band. However, application of the present invention allows a small antenna having less change or deterioration in antenna characteristics even when various objects come close to the antenna to be configured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-253435, filed on Dec. 28, 2017, which is hereby incorporated by reference herein in its entirety.

What is claimed is:

1. An antenna comprising:

a feeding point;

an antenna element unit having one end connected to the feeding point and the other end connected to a ground conductor; and a first conductive portion connected to the ground conductor, wherein the antenna element unit comprises, between the one end and the other end, a second conductive portion having a helical shape, wherein at least a part of the antenna element unit and at least a part of the first conductive portion are electromagnetically coupled with each other, and wherein at least a part of the first conductive portion is arranged inside the second conductive portion.

2. The antenna according to claim 1, wherein the first conductive portion and the second conductive portion are electromagnetically coupled with each other.

3. The antenna according to claim 1, wherein the antenna element unit and at least a part of the first conductive portion are formed on a substrate.

4. The antenna according to claim 1, wherein the antenna element unit and at least a part of the first conductive portion are arranged in an inner layer of a multilayer substrate.

5. The antenna according to claim 1, wherein the antenna element unit and the first conductive portion are not arranged in at least one of a lowermost layer and an uppermost layer of a substrate.

6. The antenna according to claim 3, wherein the substrate is a dielectric substrate.

7. The antenna according to claim 1, wherein a length of the antenna element unit is shorter than a half a wavelength in a frequency band in which the antenna operates.

8. The antenna according to claim 3, wherein at least a part of the first conductive portion is arranged to overlap at least a part of the second conductive portion when viewed from a direction perpendicular to a face of a substrate.

9. An antenna comprising:

a feeding point;

an antenna element unit having one end connected to the feeding point and the other end connected to a ground conductor; and a first conductive portion connected to the ground conductor, wherein the antenna element unit comprises, between the one end and the other end:

a second conductive portion having at least partially a spiral shape and/or a helical shape in which two or more winding parts are formed; and a third conductive portion having at least partially a spiral shape and/or a helical shape in which one or more winding parts are formed, wherein at least a part of the antenna element unit and at least a part of the first conductive portion are electromagnetically coupled with each other, and wherein at least a part of the first conductive portion is arranged between the second conductive portion and the third conductive portion.

10. The antenna according to claim 9, wherein the first conductive portion is electromagnetically coupled with the second conductive portion or the third conductive portion.

11. The antenna according to claim 9, wherein the antenna element unit and at least a part of the first conductive portion are formed on a substrate.

12. The antenna according to claim 11, wherein the antenna element unit and at least a part of the first conductive portion are arranged in an inner layer of a multilayer substrate.

13. The antenna according to claim 11, wherein the antenna element unit and the first conductive portion are not arranged in at least one of a lowermost layer and an uppermost layer of the substrate.

14. The antenna according to claim 11, wherein the antenna element unit is arranged to overlap at least partially with the first conductive portion when viewed from a direction perpendicular to a face of the substrate.

15. The antenna according to claim 9, wherein a length of the antenna element unit is shorter than a half a wavelength in a frequency band in which the antenna operates.

* * * * *